US005333565A

United States Patent [19]

Frye

[11] Patent Number: 5,333,565

[45] Date of Patent: Aug. 2, 1994

[54] THREAD CUTTING VIA RECIPROCATING ARM WITH POCKETS AND A TRIMMING PLATE

[75] Inventor: Ricky J. Frye, Miamisburg, Ohio

[73] Assignee: MIM Industries, Inc., Miamisburg, Ohio

[21] Appl. No.: 969,028

[22] Filed: Oct. 30, 1992

[51] Int. Cl.[5] ..... D05B 65/02

[52] U.S. Cl. ..... 112/291; 112/301

[58] Field of Search ..... 112/285, 288, 291, 292, 112/295, 296, 298, 300, 301

[56] References Cited

U.S. PATENT DOCUMENTS

| | | | |
|---|---|---|---|
| 3,648,634 | 3/1972 | Van Hazendonk | 112/292 |
| 4,455,957 | 6/1984 | Vollmar | 112/292 |
| 4,558,654 | 12/1985 | Schilling et al. | 112/298 |
| 4,726,305 | 2/1988 | Seto | 112/292 X |
| 4,879,960 | 11/1989 | Prais | 112/291 |
| 5,005,504 | 4/1991 | Albrecht et al. | 112/285 X |
| 5,125,351 | 6/1992 | Prais et al. | 112/292 |

FOREIGN PATENT DOCUMENTS

| | | | |
|---|---|---|---|
| 3168180 | 7/1991 | Japan | 112/292 |
| 0711205 | 2/1980 | U.S.S.R. | 112/292 |

*Primary Examiner*—Clifford D. Crowder
*Assistant Examiner*—Ismael Izaguirre
*Attorney, Agent, or Firm*—Joseph G. Nauman

[57] ABSTRACT

A thread cutting mechanism is added to a chainstitch sewing machine, including a trimming plate, fitted on the machine in alignment with the needle and looper and associated mechanism. A guideway in the bottom of the plate, extends along a path crossing the loops of the upper and lower threads. A slide moves in the guideway, and has an arm with a pointed free end extendable from the slide to move in and out of the guideway. Pockets formed along a side of the arm capture portions of the upper and lower threads in the sewing head, preparatory to forming a stitch. The slide is reciprocated when a stitching operation ends, extending the arm out of the guideway, pushing aside the upper thread and adjacent lower thread. The arm at its forward extension aligns the pockets with the upper and lower threads, so they engage within the pockets. When the slide retracts the arm draws the threads between the plate and arm. Knife edges on the plate and on an edge of the outermost pocket sever the lower and upper threads simultaneously upon completion of reverse slide motion to free the previously formed stitches from the portions of the threads engaged by the needle upper and the loop forming means. The end of the lower thread leading to the looper is retained to prevent its withdrawal from the looper head during starting of the next sewing operation. A slack portion is formed into the lower thread, upstream of its entry into the looper head. Tension in the needle thread is released during the trimming process to avoid additional tension being created during trimming/cutoff.

12 Claims, 6 Drawing Sheets

THREAD CUTTING VIA RECIPROCATING ARM WITH POCKETS AND A TRIMMING PLATE

TECHNICAL FIELD

This invention relates to automatic thread trimming for chain stitch sewing machines.

BACKGROUND OF THE INVENTION

Prior Thread Cutting Devices

In the field of machinery for the textile industry, primarily industrial sewing machines, there exist many types of sewing machines. Principal types are commonly referred to as chainstitch, lockstitch, and overlock. Within these types are many configurations of the bed or the arm of the machine itself. Such configurations are commonly referred to as flatbed, cylinder bed, post bed, and sub frame (e.g. overlock) machines. Many items are common to all of these machines; they employ some form of material feeding device, and a reciprocating needle(s), and all employ the use of thread in order to join materials together and or to cause reinforcement to materials or to apply a decorative stitch.

Certain machines employ one or more needles in order to perform the various types of stitching as described above. For example at times more than one needle is required to create a specific federal stitch type, one example being a type 406.

Such sewing machines are commonly used to sew and create a series of stitches referred to as a seam, and after having created such a seam, it is required to trim the thread(s) of the seam so the sewn work piece can be removed from the machine. This requires the machine operator to use a device such as scissors, or (in most cases) the machine itself will be equipped with some form of thread cutting device. Such thread trimming devices are of various types depending upon the machine itself.

Some of the most common forms of automatic or semiautomatic thread cutting devices that are applied to machines are impact cutters, chain cutters, and underbed thread cutters. Impact cutters are of the type that cause the threads to be severed by a knife edge that impacts the thread against a flat surface. This type of cutter can be applied to most any type of sewing machine, but requires that the series of stitches being created continue to form off the edge of the work piece being sewn. In doing so, a chain of stitches is usually created and remains attached to the work piece. This is often unacceptable as it may interfere with the appearance of the work piece. Impact cutters are most common to overlock and chainstitch machines, which are capable of creating a chain of stitches. Use of an impact cutter on a lockstitch machine is usually not popular, but is possible.

The chain cutter type of thread cutting devices is most popular on chainstitch and overlock type machines. Like the impact cutter, the chain cutter type requires that a series of stitches continue to be created in the form of a chain off the edge of the work piece being sewn. The threads are severed by a shearing type device in the form of a small scissor action type device. This sometimes requires the use of a venturi device to pull the threads into the cutting device. The remaining thread chain is usually still intact with the sewn work piece and can also have an effect on the appearance of the work piece, as mentioned with respect to the impact cutters. The ability to initiate another series of stitches must be accomplished at the edge of the work piece, otherwise the chain of stitches remaining within the machine must be separated. This separation of the needle and looper thread(s) is required if it is desired to initiate a series of stitches at any area of the work piece other than an edge. This applies also to impact cutters.

Another type of thread cutting device is the underbed thread cutter, which is mostly popular with lockstitch type machines. Although underbed cutters have been applied to some chainstitch type machines, as in the case of machines manufactured by Union Special Corp., Kansai Special, Singer, and Juki. The underbed cutters for these machines are applied by the original equipment manufacturer, or in some cases by an after market supplier.

Underbed Thread Cutters

The underbed thread cutting device is a type of device which allows the threads to be severed below the surface of the bed or throat plate of the machine. The function of the underbed thread cutter is different from that of others mentioned. When this type of cutter is applied to a lockstitch type machine, it is usually required to activate during formation of a stitch at the end of a determined sewing sequence. It is necessary to capture the thread loop of the needle thread while it is passing over the hook of the machine during the stitch formation. This is usually the only period of time in which the needle thread can be captured below the bed or throat plate surface in order to severe the needle thread. It should be noted that in this specification the lower thread is usually referred to as the looper thread, and is always below the surface of the bed or throat plate of the machine in the process of forming stitches.

A known advantage of an underbed thread cutter or trimmer is the ability to cause the threads to be trimmed without having to sew off of the edge of the work piece being sewn. This feature allows for the series of stitches to be terminated prior to the edge of a work piece and also allows for a series of stitches to be initiated at any area of the work piece without having to separate the upper and lower thread(s) of the chain of stitches.

It is possible to employ two separate devices to severe the thread(s) of a work piece being sewn. This has been seen on machines manufactured by the Singer Company and possibly the Juki Company, Juki literature does not appear to indicate whether the upper device, located to the left of its needle bar, in fact cuts and retains the needle thread or only retains the needle thread.

This type of device which would employ two separate cutting devices is one in which some form of a thread cutting device is located below the surface of the bed or throat plate of the machine, This device would be used to sever thread(s) of the looper of a chainstitch machine or the bobbin of a lockstitch machine. A separate device would then be located above the surface of the bed of the machine and possibly located to the left of the needle bar of the machine. This device could extend and capture the upper needle thread of the machine and pull it into a mechanism in which the thread would be severed, It is also possible the same device would but not necessarily be required to retain the upper needle thread.

Thread Cutting in Chainstitch Machines

There appears, therefore, to be a need for a relatively simple and easily operated underbed thread cutter apparatus for chainstich sewing machines. The purpose of this invention is to provide a novel method and underbed cutter for cutting or severing the thread(s) of a chainstitch sewing machine at the termination of a series of stitches, especially if the series of stitches ends short of an edge of the work piece.

A multi-thread chainstitch (stitch class 400) is formed such that each thread loop is interlooped with the loop of another thread. Depending on the stitch type, two-thread chainstitch seams may be made from two or more threads. The top and underside of the seam are different in appearance. The needle thread is visible on the underside of the material (work piece) so the needle thread can only be adapted in color to one side of the material, Depending on stitch type used, thread consumption in a chainstitch is five or more times the length of the seam made with this stitch.

When made with correct thread tension, chainstitch seams have higher extensibility than lockstitch seams, but are more prone to open up when subjected to a crosswise pull (called "grinning"). Depending on the type of material used, chainstitch seams are relatively ease to unravel in the reverse direction. A number of special seam types are derived from the two-thread chainstitch, e.g. overedge seams, covering seams, etc.

SUMMARY OF THE INVENTION

The apparatus device and method of the invention relates to a thread trimming or cutoff for addition to a sewing machine which employs one or more needles, each needle preferably (but not necessarily) having an oscillating looper associated with it, the needle and looper combining two threads in the formation of a particular federal stitch type. For purposes of explanation a Federal 401 stitch type is described, however those skilled in the art will appreciate that the invention is applicable to other stitches.

The purpose of the invention is to provide automatic thread cutoff or trimming, in the form of either an after-market attachment or an added feature to an originally manufactured sewing machine, upon operator termination of a series of stitches.

In the sewing machine at least one upper and one lower thread are separately supplied to the sewing head of the machine, and an orbiting looper in the machine bed receives a lower thread while a reciprocably driven needle, mounted above and movable through a sewing plate, receives a separate upper thread. The needle and looper cooperate to form sequential loops of the upper thread around the looper and to move the lower thread through the upper thread loops, thereby creating a succession of stitches in a work piece. Sewing machines having such mechanisms are known, a typical machine being a Pfaff 5480 series machine.

This invention provides an improved thread cutoff or trimming mechanism which can be added to such a sewing machine. A trimming plate, having upper and lower surfaces, is dimensioned to fit on the sewing machine in predetermined alignment with the sewing head, e.g. the needle and looper and associated mechanism. A guideway is formed in the bottom of the trimming plate, extending along a path which can be aligned to cross the loops of the upper and lower threads. A movable slide operates in and along the guideway, and has an arm (preferably integral with the slide) having a free end and extending from the slide for movement in and out of the guideway.

Pockets are formed in and along a side of the arm for capturing portions of the upper and lower threads which are positioned in the sewing head, preparatory to forming a stitch. The slide is reciprocated at completion of a stitching operation (e.g. the end of sewing a seam) to extend the arm forward out of the guideway and to push aside part of the upper thread and the adjacent portion of the lower thread. The arm is located at its forward extension presenting the pockets in alignment with the upper and lower threads, whereby the upper and lower threads can engage within separate ones of the pockets.

When the slide is retracted the arm is within the guideway, drawing the threads between the trimming plate and the arm. Cooperating knife edges on the trimming plate and on an edge of the outermost pocket sever the lower and upper threads upon completion of the reverse motion of said slider to free the previously formed stitches from the portions of the threads still engaged respectively by the needle and the loop forming means. The end of the lower thread, leading to the looper, is temporarily retained to prevent the lower thread being withdrawn from the looper head during starting of the next sewing operation. As part of this function, an extended end of the lower thread is retained in the arm by providing a recess between the two pockets through which the lower thread can pass. Thus, both threads are severed at the same time, not sequentially, although the pockets capturing these threads move into the guideway in sequence.

Another feature of the invention is a device for pulling a slack portion into the lower thread, upstream of its entry into the looper head. This, together with the retention of the lower thread beyond the looper head, assures that the lower thread remains properly threaded in place through the looper as stitching again commences.

Since such machines are usually provided with tensioning devices in the supply of the upper or needle thread(s) to the sewing head, the invention also provides a means, as part of the trimming sequence, for releasing that tension during the trimming process to avoid undesired additional tension being created during trimming/cutoff.

The principle object of the invention is to provide a novel thread trimming or cutoff mechanism added to a chainstitch sewing machine; to provide such a trimming mechanism including a trimming plate, having upper and lower surfaces, which can be fitted on the machine in alignment with the sewing head, e.g. the needle and looper and associated mechanism, with a guideway formed in the bottom of the plate, extending along a path crossing the loops of the upper and lower threads, a movable slide operating in the guideway, and at least one arm with a pointed free end extending from the slide to move in and out of the guideway; to provide such a mechanism with pockets formed in and along a side of the arm to capture portions of the upper and lower threads in the sewing head, preparatory to forming a stitch, to provide such a mechanism in which the slide is reciprocated at completion of a stitching operation to extend the arm out of the guideway, to push aside part of the upper thread and an adjacent portion of the lower thread, to align the pockets with the upper and lower threads when the arm is at its forward extension, so they engage within separate ones of the pockets, and when the slide is retracted the arm is within the guideway, drawing the threads between the trimming plate and the arm; to provide such a trimming mechanism wherein cooperating knife edges on the trimming plate and on an edge of the outermost pocket sever the lower and upper threads upon completion of the reverse motion of said slide, to free the previously formed stitches from the portions of the threads still engaged by the needle upper and the loop forming means, with the end of the lower thread leading to the looper retained to prevent it being withdrawn from the looper head during starting of the next sewing operation; to provide such a trimming mechanism wherein a slack portion is formed into the lower thread, upstream of its entry into the looper head, and wherein tension in the needle thread is released during the trimming process to avoid additional tension being created during trimming/cut-off.

Other objects and advantages of the invention will be apparent from the following description, the accompanying drawings and the appended claims.

DESCRIPTION OF THE PREFERRED EMBODIMENT

Figure 1:
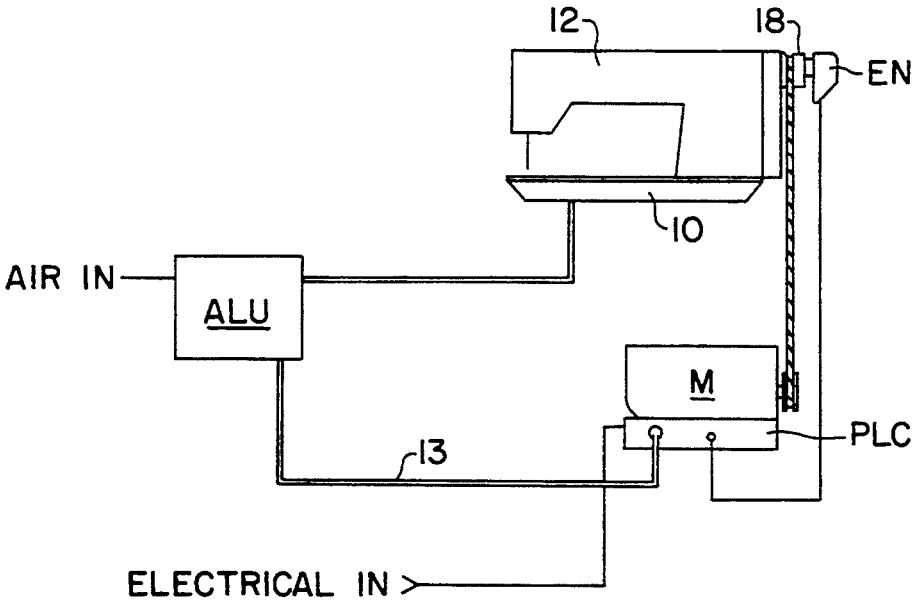
FIG. 1 is a schematic diagram of a sewing machine system to which the invention is applicable.

The invention is hereinafter described with reference to its application to a two needle type of chainstitch sewing machine, which is typified by a form of a Pfaff 5480 series machine. Where appropriate threads and machine elements which are duplicated for a two thread machine are designated with the same reference numeral and the suffixes A and B. It should be understood that the principles of the invention are fully applicable to a single needle machine.

Figure 2:
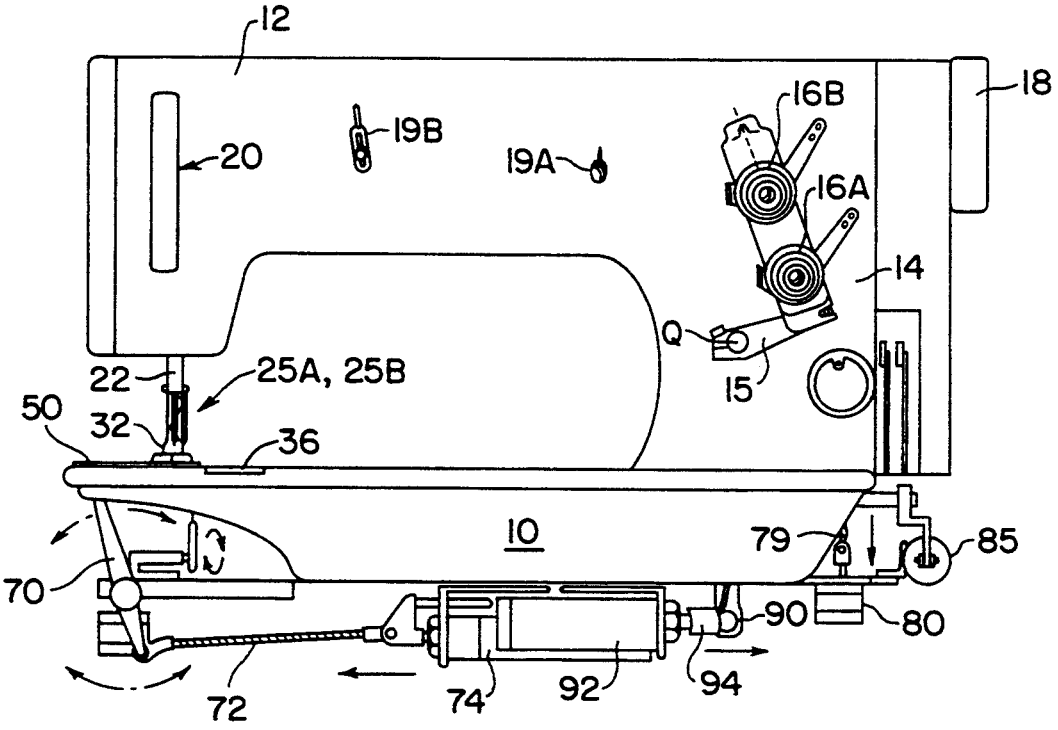
FIG. 2 is an over-all side view of a typical chainstitch machine to which the invention can be added.

Referring to FIG. 2 the bed 10 of such a machine, in addition to providing a base and a housing for much of the underbed mechanism, supports the upper arm 12 of the machine, which arm extends from an upright 14 projecting from bed or base 10. A lever 15, when rotated clockwise will cause one or more tension disc devices 16A, 16B to open, as by releasing spring pressure applied to their discs which otherwise causes thread passed through the tension devices to be restrained. Handwheel or pulley wheel 18 of the machine, coupled to a drive motor M via a V-belt (see FIG. 1) will cause the handwheel to rotate, providing power to the sewing head supported within arm 12, and through known linkages to the mechanisms in bed 10. Members 19A and 19B are thread guides to support the needle threads coming from tension discs 16A, 16B to the upper take-up 20 of the machine.

Motor M incorporates a master controller PLC. These types of motors and controllers in this industry are referred to as needle positioning motors. Such motors are electronically controlled and to cause and monitor the position of the needle(s) during sewing such that when the machine is stopped the needle position will be at a desired point for purposes of trimming or removing a work piece from the machine. This monitoring or position feed back (closed loop) process is performed with the aid of an encoder EN which sends a signal to controller PLC, enabling the motor to monitor the relative position of the needle of the machine. Since trimming of the threads must be at a predetermined position of the looper mechanism and the needle bar (as later described) a motor and controller of this type is required. When the machine operator has signaled the controller that a trimming process is to be initiated, the motor will cause the looper mechanism to move to its desired position, and the controller will send an electrical signal via cable 13 to an air logic unit ALU. The air logic unit converts this electrical signal to a series of air signals that are feed to the air cylinders of the trimming system as later described. A complete cycle of the trimming process is thus performed.

Upper take-up 20 moves with the reciprocating motion of a needle bar 22 carrying one or more needles 25A, 25B. The needle thread(s) NT1, NT2 (see FIGS. 4 and 7–14) are then guided down to the needles and through their respective eyes, so stitching may occur.

The presser foot 32 of the machine can be raised and lowered to compress the material (work piece) being sewn against the throat or needle plate 35 (FIG. 3B) such that a proper stitch formation will occur. This also allows the feed dog of the machine (not shown) to compress the material for feeding purposes. A looper access plate 36 allows access to the looper mechanism 40 (see FIGS. 3,7 and 8) and other adjacent components within bed 10.

Plate 36 also provides a means for access to the looper in order to insert the lower or looper threads LT1, LT2 which are guided from a tension disc at the rear of the machine (not shown) and through a recessed area of base 10, into and through the looper thread puller assembly and into the looper head(s) 45A, 45B. The open space to the left of the looper heads and mechanism, in FIG. 3A, is usually covered by another access, but such plate is replaced by the trimming plate and assembly of the present inventions as later described.

Looper heads 45A, 45B are moved in an oscillating motion in respect to the looper thread supply during the formation of a stitch. This motion can be simply described as in an elliptical path which is slightly curved in a vertical direction. Heads 45A, 45B move to the left and back, across the vertical path of needle motion, as seen in FIGS. 3A and 3B. The looper thread puller or regulator 42 includes a pair of spaced apart arms 43 which have holes through their upper ends, and which are moved in an oscillating motion toward and away from the regulator 42 which has an adjustable gap therein.

One or more of the looper threads LT1, LT2 are supplied together through the bed (as mentioned above) and pass (together if there are two) through the hole in one arm 43, thence through the gap in regulator 42, through the hole in the second arm 43, and to the slots 46A, 46B in the respective looper heads 45A, **45*b*. These paths of the looper threads can be seen in FIGS. 7 and 11. This allows the looper thread puller assembly to create slack in the lower or looper threads, and to take up slack in the lower threads, at designated times during stitch formation. The function of these components, and the cooperation of the looper heads 45*a*, 45B with needles 25A, 25B are per se known. Suffice to say that the timing of needle movement to carry the needle thread NT1 downward through a work piece and upward out of the work piece, and the orbiting motion of the looper head to carry a looper thread LT1 through the loops in the needle threads (see FIGS. 7 and 8), results in the chainstitches, which are illustrated in the sequence of FIG. 4A–E. FIG. 8 is an illustration of the thread formation for each stitch of the two separate stitch formations being formed. A loop of each needle thread NT1, NT2 is formed about a corresponding looper head 45A, 45B, and each looper thread LT1, LT2 passes through the needle thread loops, then upward to the previously formed stitch. For clarity, one set of both needle and looper threads have been omitted in FIGS. 10, 12 and 14**.

Figure 3A:
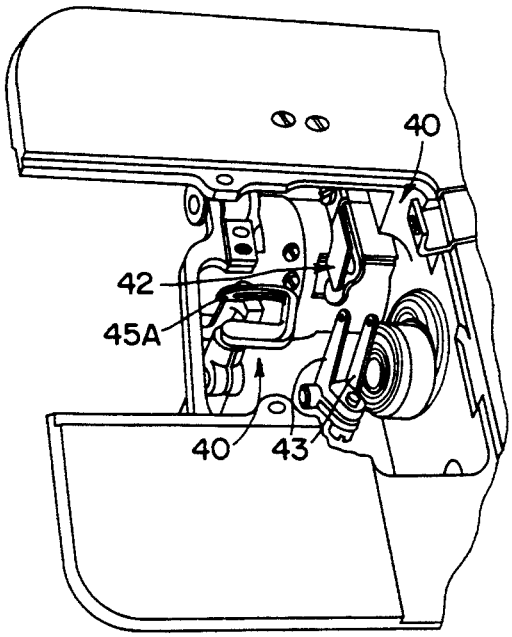
FIGS. 3A and 3B are perspective and side views, respectively, of the needle and looper mechanism of the typical machine shown in FIG. 2.
Figure 3B:
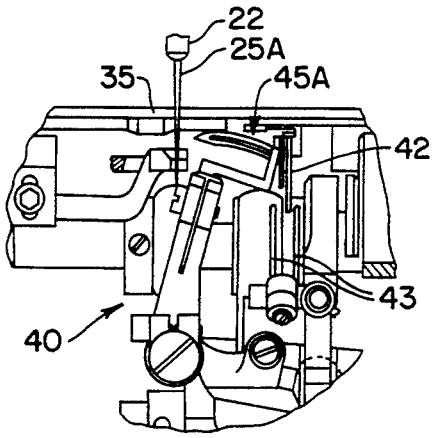
Figure 4A:
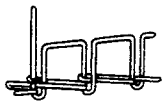
FIGS. 4A—4E illustrate steps in the formation of a type 401 chainstitch.
Figure 4B:
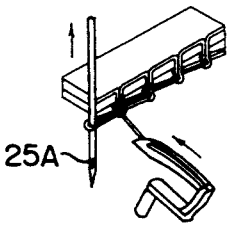
Figure 4C:
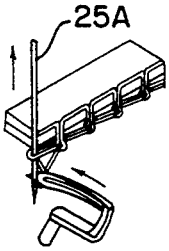
Figure 4D:
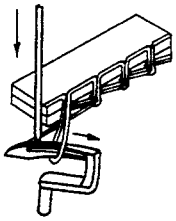
Figure 4E:
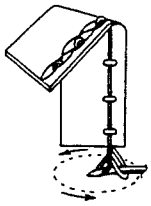
Figure 5:
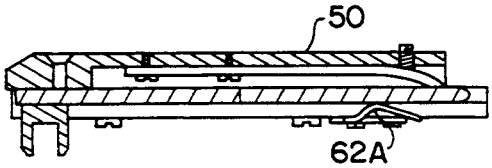
FIG. 5 is a cross-section view taken through the sewing head plate and slide which is a feature of the invention.
Figure 6:
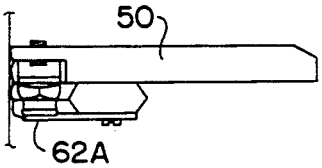
FIG. 6 is and end view of the parts shown in FIG. 5, as seen from the right of FIG. 5.
Figure 15:
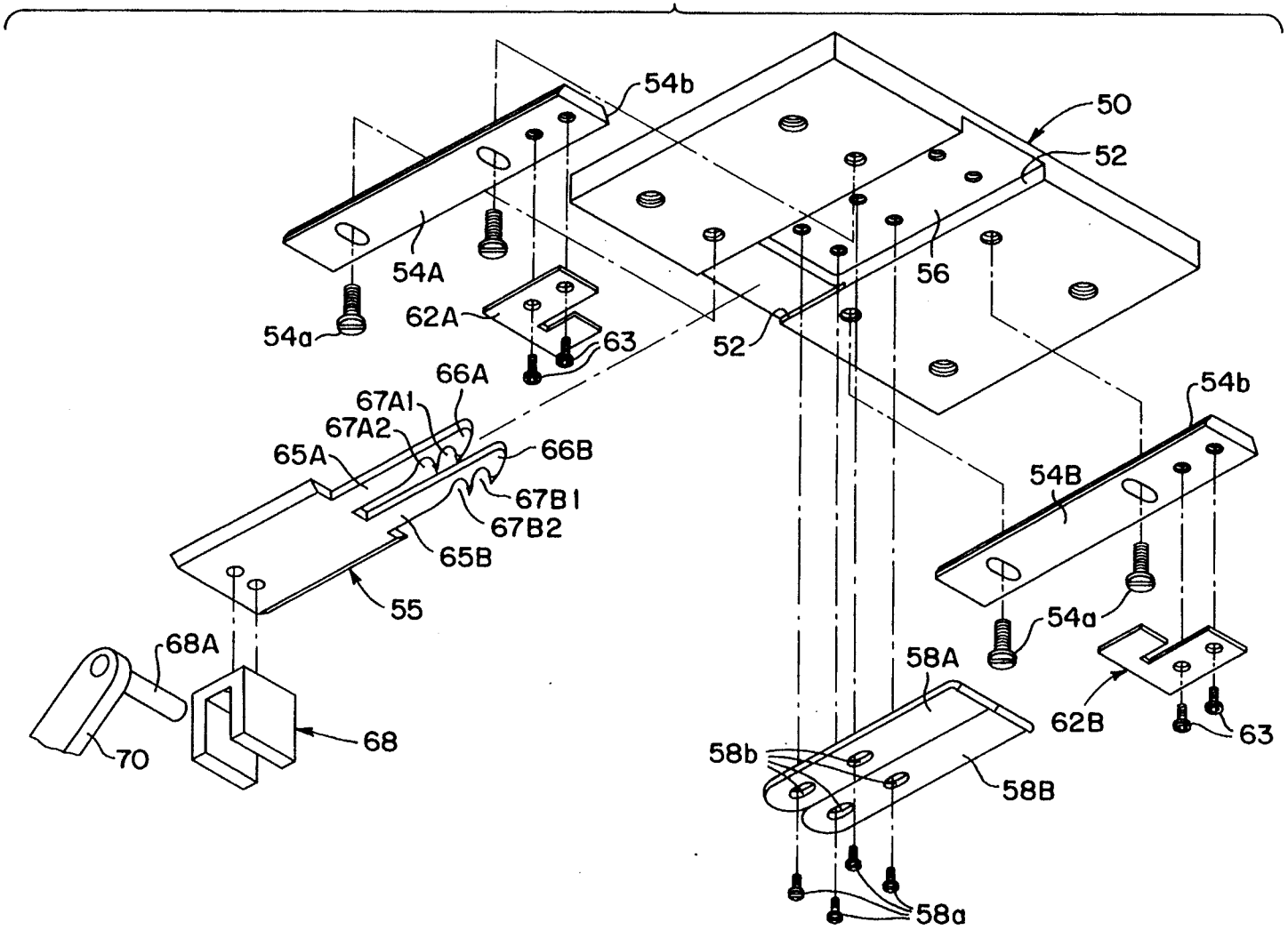
FIG. 15 is an exploded view of the parts which make up the underbed cutting and capturing mechanism provided by the invention.

The trimming plate assembly is based on the main trimming plate 50 (FIG. 15) which is dimensioned to fit into the gap of the bed 10 to the left of the sewing head and the base beneath it (see FIG. 3A). Plate 50 has a guideway structure which comprises a transverse slot 52 formed in its bottom and a pair of gibs 54A, 54B attached by screws **54*a* to the bottom of plate 50 along the edges of slot 52, each gib having a beveled edge 54*b* to form a guideway for a slide 55, on which is formed cooperating beveled edges 55A, 55B. Slot 52 also has a pocket 56 formed in its upper surface, receiving a pair of fixed stationary knife(s) 58A, 58B attached to trimming plate 50 by screws 58*a* extending through elongated slots 58*b* in the knives. The cutting edges 60A, 60B of knives 58A, 58B are also seen in FIGS. 5, 7, 11 and 13. Adjustment of the cutting edge plane of each knife with reference to the top surface of the movable knife is performed by adjusting screws 58*a***, independently for each fixed knife.

Attached to each gib 54A, 54B is a looper thread retainer 62A, 62B, secured to a respective gib by a pair of screws 63. As later explained in more detail, the purpose of thread retainers 62A, 62B is to provide a means for retaining looper threads LT1, LT2 with respect to the looper after trimming the threads. This is a key element as it prevents the lower or looper thread form being pulled out of the looper head 45A, 45B by the looper puller mechanism 40 when a new stitching process is initiated after having trimmed the threads. The looper thread that is captured in the retainer will be removed from the retainer when the feeding of material takes place during the newly initiated sewing cycle. This usually requires one to four stitches depending on the length of the stitch.

Slide 55 includes a pair of independent extensions or arms 65A, 65B extending from one end of the slide, preferably as integral parts of the slide. Each arm has a pointed (but slightly rounded) tip **66*a*, 66B and on one of its sides is formed a pair of hook-like pockets 67A1, 67A2 and 67B1, 67B2, which constitute a thread capture device and (with respect to the forward edge of pockets 67A1, 67B1) movable knives of the trimming system. The upper surface of each arm is relieved (e.g. cut away) at the portions 64A, 64B (FIG. 9), which are located along the forward edge of pockets 67A2, 67B2**, for reasons explained later.

The movable knife slide 50 is reciprocated laterally along slot 52, guided by the two gibs **54*a*, 54B. A yoke 68 is fastened to the bottom of slide 50, and a cylindrical pin 68A attached to an oscillating arm 70 (FIGS. 2 and 15) fits within yoke 68 and can cause slide 50** and its movable knives to reciprocate.

Figure 7:
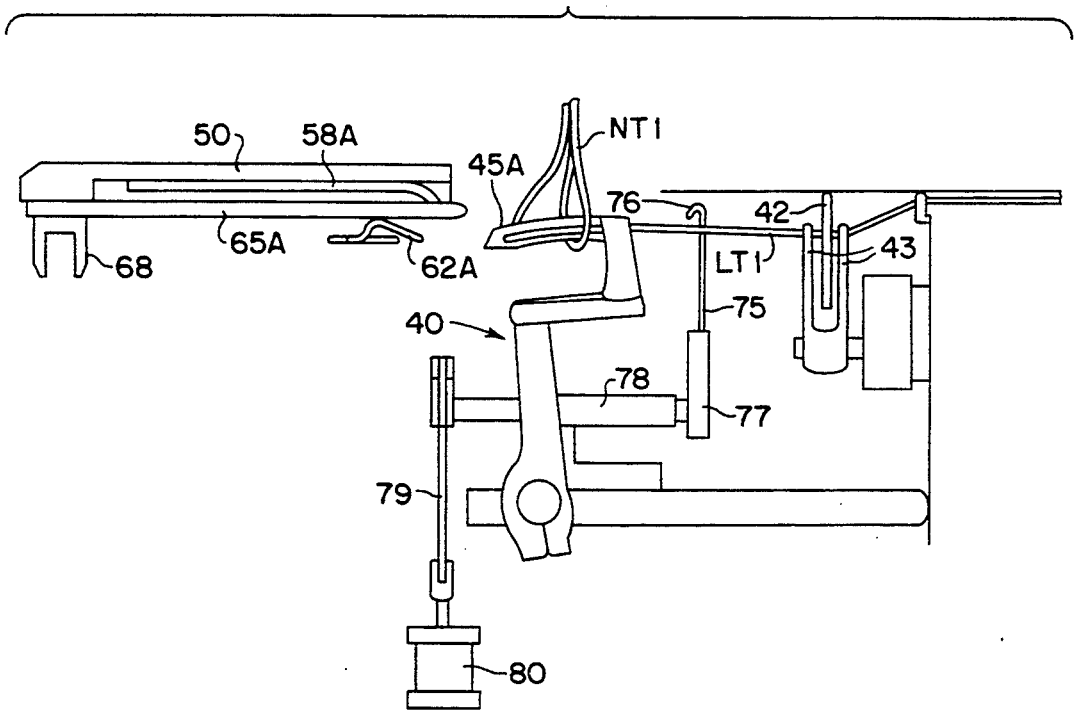
FIG. 7 is an enlarged detail view showing the trimming plate and slide of FIG. 5 together with the looper mechanism of FIG. 3, and with the needle raised out of the view for clarity.
Figure 8:
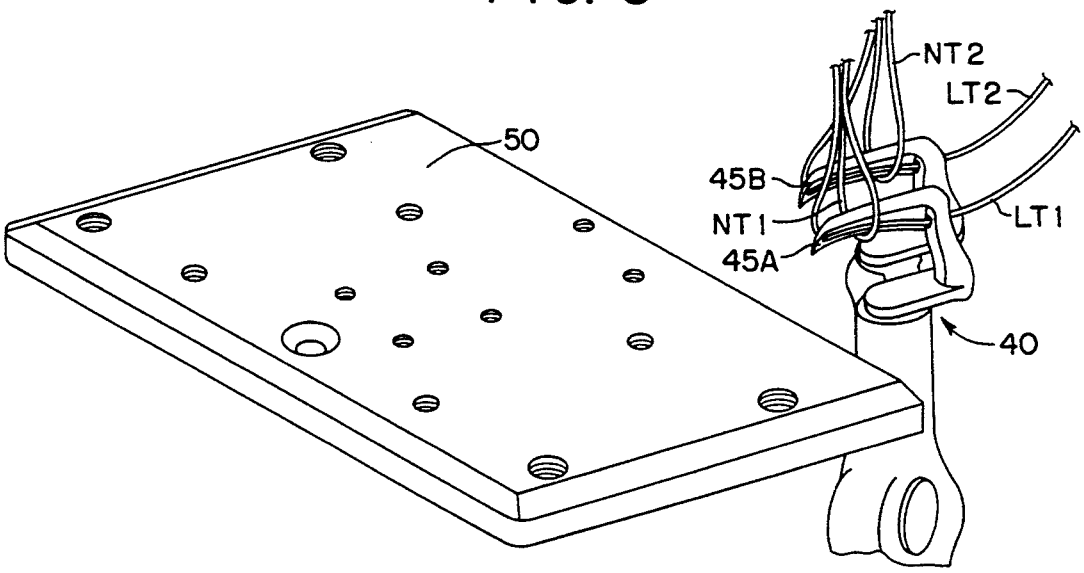
FIG. 8 is an enlarged perspective view of the trimming plate and the double looper mechanism, with the looper threads in place and loops of the needle threads about the looper mechanism.

A looper thread trimming puller arm 75, having a short hook 76 at its outer end, is mounted on a rotatable arm 77 which positions hook 76, at its rest position, slightly above and behind the path of the looper threads (FIG. 7). Arm 77 is fixed to a shaft 78, which is in turn connected through link 79 to an actuator air cylinder 80. Energizing cylinder 80 causes arm 75 to rotate approximately 80° forward, toward the front of bed 10 (compare FIGS. 7 and 11) and pull additional thread through the puller apparatus 40 while the threads are still attached to the stitched seam at the end of a seaming operation. Excess looper thread is pulled off to create slack in the looper thread after trimming, so the lower take-up of the machine will not cause tension in the looper thread secured in the retainer to pull the looper thread(s) out of the looper head(s) during the first 1 to 4 stitches of a new (subsequent) series of stitches.

Referring to FIGS. 5, 7, 11 and 13, the top surface of slide 50 maintains contact with the cutting edges 60A, 60B of the stationary knives during the reciprocating motion of the slide. When a seaming operation has ended the parts are in the positions shown in FIGS. 7 and 8, and the operator can signal the beginning of a trimming sequence. This may be accomplished in a number of ways. One convenient way is to actuate an air sequencer logic unit ALU (FIG. 1) by moving a machine control treadle past (heel down) its stop position. This initiates the operation of the trimming sequence.

Figure 9:
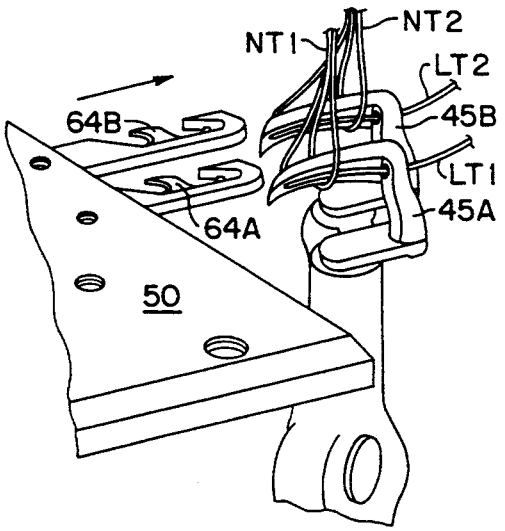
FIG. 9 is a view similar to FIG. 8, with the thread capture and cut-off barbs extending as their slide progresses in the beginning of a thread capturing/cutting sequence.
Figure 10:
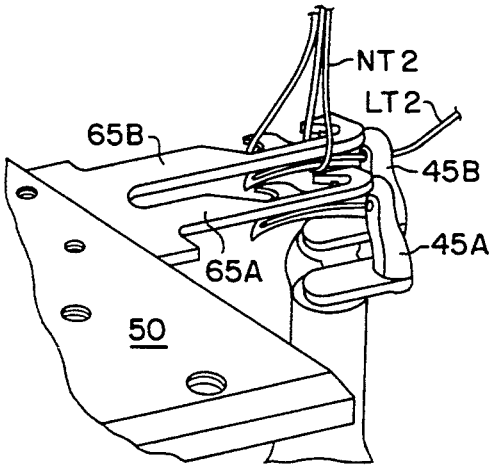
FIG. 10 is a further similar view, showing the slide fully extended and the barbs engaged within the needle thread loops.
Figure 11:
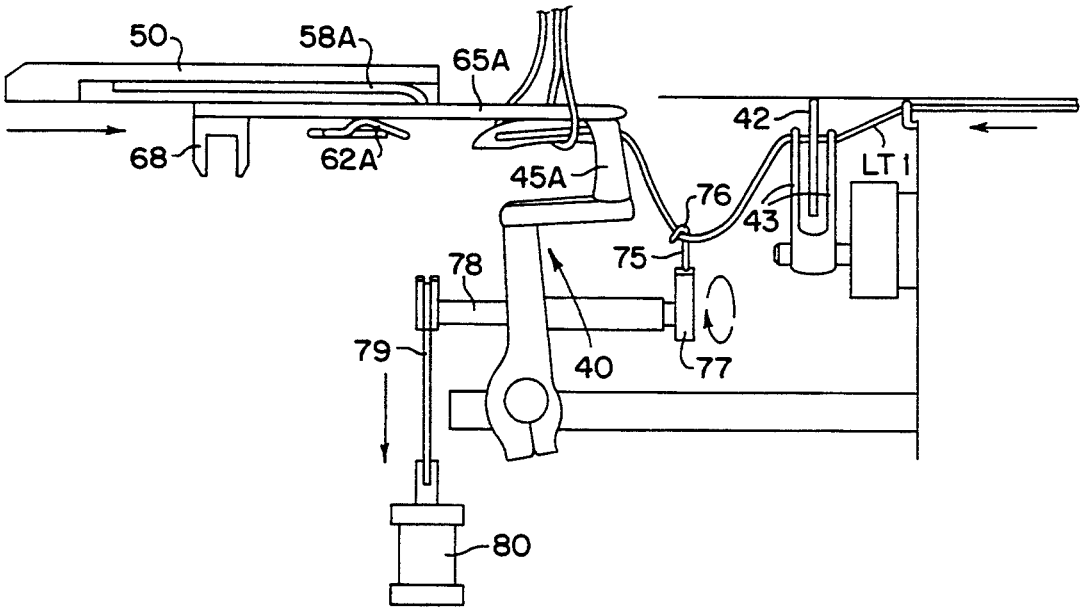
FIG. 11 is a view similar to FIG. 7, with the slide fully extended.
Figure 14:
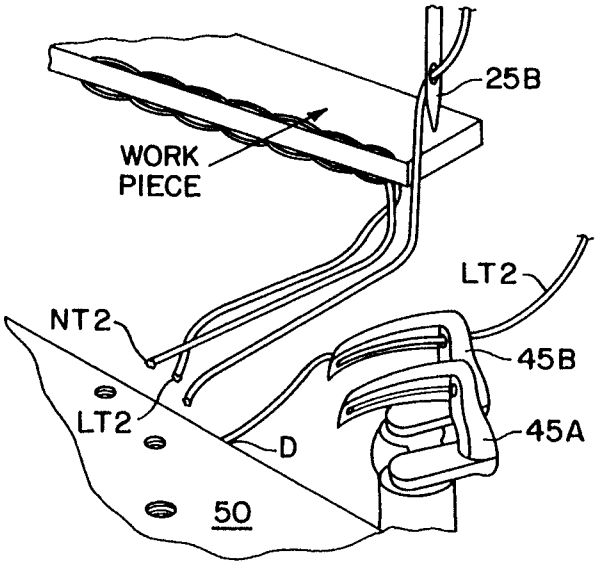
FIG. 14 is a view similar to FIG. 12, showing the ends of the severed threads.
Figure 13:
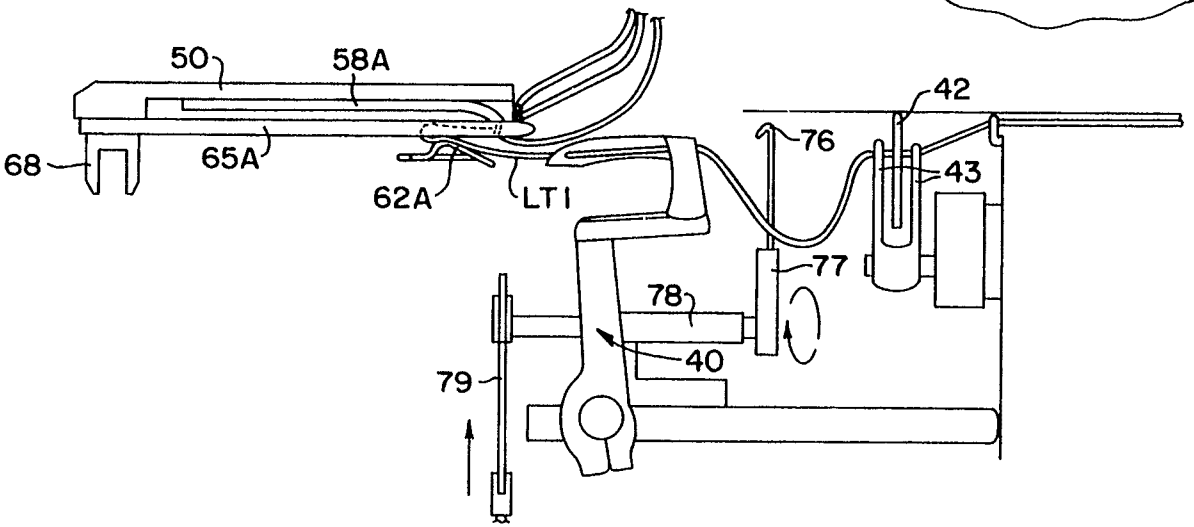
FIG. 13 is a view similar to FIG. 11 with the slide fully retracted and the threads severed.
Figure 12:
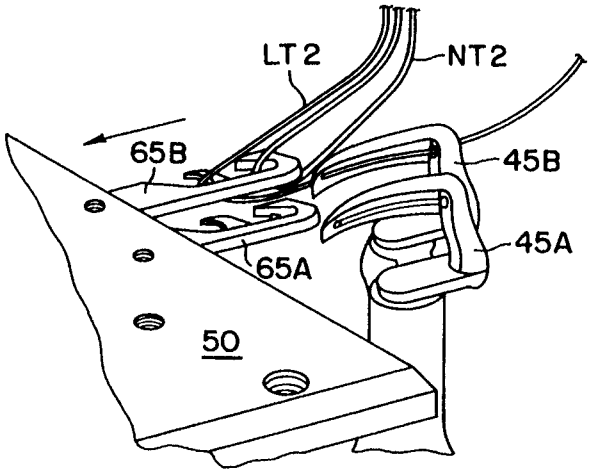
FIG. 12 is a view similar to FIGS. 8 and 9, with the slide retracting under the trimming plate.

Arm 70 is connected via link 72 to and air cylinder 74. This cylinder is actuated to reciprocate arm 70 (see FIG. 2), producing the extend/return motion of slide 50. At the end of the slide advance, the tips 66A, 66B on arms 65A, 65B enter the loops of the needle and looper threads, as shown in FIGS. 9, 10 and 11. The needle threads NT1, NT2 are aligned with pockets 67A1, 67A2, and the looper threads LT1, LT2 are aligned with pockets 67A2, 67B2. Since these threads are effectively pushed aside slightly as the slide arms 65A, 65b pass by, and the threads are then under some tension, one side of each needle thread loop enters pockets 67A1 and 67B1; the portions of the looper threads extending upward from the looper heads 45A, 45B enter pockets 67A2 and 67B2. The blunt point on the front of each arm of the movable knife allows the arm to penetrate more easily through the loop formations.

At this point the slide 50 and arms 65A, 65B have reached full extension. Cylinder 80 is actuated to draw thread through puller apparatus 40 by rotating arm 75 approximately 80° in a direction toward the front of bed 10 (see FIG. 11). A further air cylinder 85, linked to tension control arm 15, is actuated to release the tensioning disc devices 16A, 16B and this allows some slack in the needle threads NT1, NT2 when the slide 50 returns, pulling the captured threads with it. When slide 50 has fully extended and then begins to retract, an air signal is supplied to actuate cylinder 85. This signal is only momentary but is equal to or greater than the duration of the return stroke of slide 50.

Returning to the sequence of the trimming operation, the motion of slide 50 is then reversed, and the threads are drawn back to the trimmer assembly, with the top surface of the arms moving against the stationary knife edges 60A, 60B. The relieved portions 64A, 64B of the slides allow the captured looper threads LT1, LT2 not to be cut until they reach the same point as the needle NT1, NT2 and the moving knife edges cooperate with the stationary knife edges 60A, 60B to shear all four threads (see FIG. 13). By this time slide 50 has pulled the looper threads each into a respective retainer 62A, 62B on the bottom of the trimmer assembly.

The needle threads NT1, NT2 now have been severed and remain free, and the looper threads LT1, LT2 that were attached to the work piece are also severed and free, so the work piece can be removed from the machine. However, the threads LT1, LT2 from the looper heads have been secured in the retainers (see FIGS. 13 and 14).

As part of an upgrade or retrofit to an existing machine, the existing presser foot lever 90 pivots in a forward motion and through a series of mechanical components causes the raising or the lifting of the presser foot 32, and it may be desirable to automate this mechanism. Lever 90 may thus be moved by means of an air cylinder 92 (FIG. 2), and this air cylinder is controlled by the ALU. Air cylinder 92 is shown coupled to a bracket 94 that is attached to lever 90.

While the methods herein described, and the form of apparatus for carrying these methods into effect, constitute preferred embodiments of this invention, it is to be understood that the invention is not limited to these precise methods and form of apparatus, and that changes may be made in either without departing from the scope of the invention, which is defined in the appended claims.

What is claimed is:

1. In a sewing machine including a sewing head and a sewing plate and wherein at least upper and lower threads are separately supplied to the sewing head of the machine, a lower orbiting looper head beneath said sewing plate and receiving a lower thread, and a reciprocably driven needle mounted above and movable through said sewing plate and receiving a separate upper thread and cooperating with the looper head to sequentially form loops of the upper thread around the looper head and to move the lower thread through such loops of the upper thread, thereby providing a succession of stitches in a work piece presented to said sewing plate;

said machine including an improved cutoff mechanism comprising a stationary trimming plate including a guideway extending beneath said trimming plate along a path which crosses the loops of the upper and lower threads, a slide movable in reciprocating fashion along said guideway and including at least one arm extending therefrom and having first and second pocket means formed on one side of said arm, said pocket means being spaced apart along said arm corresponding to the spacing of the upper and lower threads in the looper head whereby motion of said slide in one direction toward said looper head will cause said pocket means to move past the lower thread and the loop of the upper thread by pushing aside the upper thread and adjacent portion of the lower thread, means for reciprocating said slide at completion of a stitching operation to move said pocket means in said slide into alignment with the upper and lower threads and to engage the upper thread and the lower thread within said pocket means end then to reverse direction of said plate to draw said threads between said trimming plate and said slide, and cooperating knife means on said trimming plate and said slide for severing the lower and upper threads upon completion of the reverse motion of said slide to free the previously formed stitches from the portions of the threads still engaged respectively by the needle and the loop forming means.

2. An improved thread cutoff mechanism for a chainstitch sewing machine as defined in claim 1, further including retainer means on said trimming plate having means for grasping a portion of the lower thread during reverse motion of said slide.

3. An improved thread cutoff mechanism for a sewing machine as defined in claim 1, further including power operated means for moving said slide through an operating stoke between a retracted cutoff position wherein said slide is beneath said trimming plate and an extended thread capture position adjacent said loops of said upper and lower threads.

4. An improved thread cutoff mechanism for a chainstitch sewing machine as defined in claim 1, further including means for forming a slack portion in the lower thread between said pocket means and the supply of the lower thread.

5. An improved thread cutoff mechanism for a sewing machine as defined in claim 1, wherein said arm having a pointed outer end to displace portions of said upper and lower threads adjacent the needle and the loop forming means during extension motion of said slide.

6. In a chainstitch sewing machine including a sewing head and wherein at least upper and lower threads are separately supplied to the sewing head of the machine, a lower orbiting looper head beneath said sewing plate and receiving a lower thread, and a reciprocably driven needle mounted above and movable through said sewing plate and receiving a separate upper thread, said needle and said looper head cooperating to form sequential loops of the upper thread around the looper head and to move the lower thread through such loops of the upper thread, thereby forming a succession of stitches in a work piece presented to said sewing plate;

an improved thread cutoff mechanism for addition to such a sewing machine, comprising a stationary trimming plate having an upper surface and a lower surface, said trimming plate dimensioned to fit on the sewing machine in predetermined alignment with the sewing head, a guideway formed in said bottom surface of said trimming plate extending along a path aligned with the looper head to cross the loops of the upper and lower threads, a slide movable in reciprocating fashion in and along said guideway, an arm having a free end and extending from said slide for movement in and out of said guideway, first and second separate pocket means formed in one side of said arm and being spaced along said arm corresponding to the spacing of the upper and lower threads in the looper head whereby said pockets are capable of aligning with portions of the upper and lower threads, means for reciprocating said slide at completion of a stitching operation to extend said arm to a forward position out of said guideway and to push aside the upper thread and the adjacent portion of the lower thread, said reciprocating means locating said arm at the forward position presenting said separate pocket means in alignment with the upper and lower threads whereby the upper thread and the lower thread can engage each within one of said pocket means, said reciprocating means locating said arm when retracted within said guideway drawing said threads between said trimming plate and said arm, and cooperating knife means on said trimming plate and said arm for severing the lower and upper threads upon completion of the reverse motion of said slide to free the previously formed stitches from the portions of the threads still engaged respectively by the needle and the loop forming means.

7. An improved thread cutoff mechanism as defined in claim 6, further including means defining a recess formed in the top of said arm between said first and second pockets, an edge on said arm at said first pocket providing a moving knife edge and a fixed knife member on said trimming plate cooperating with said moving knife edge, means defining a recess in the top of said arm between said first and second pockets to allow passage of a lower thread captured in said second pocket between the top of said arm and said guideway whereby the captured portions of the upper and lower threads are severed together as said arm completes its reciprocating motion.

8. An improved thread cutoff mechanism as defined in claim 7, further including control means for powering said reciprocating means through a trimming cycle upon a signal indicating need for a thread trimming operation.

9. An improved thread cutoff mechanism as defined in claim 7, further including means for forming a slack portion in the lower thread between said second pocket and the supply of the lower thread whereby the lower thread is not drawn from the loop forming means during movement of said arm.

10. An improved thread cutoff mechanism as defined in claim 9, further including means for inducing tension into the supply of upper thread to the needle, and means for releasing the tension in the needle thread supply during the cycle of operation of the thread cutoff mechanism.

11. In a chainstitch forming sewing machine wherein at least a needle thread and a looper thread are supplied from separate spools external of the sewing head of the machine, the sewing head of the machine including a sewing plate, a lower orbiting looper head beneath said sewing plate and receiving a looper thread from one of the spools, and a reciprocably driven needle mounted above and movable through said sewing plate and receiving a needle thread from another spool and cooperating with the looper head to sequentially form loops of the needle thread around the looper head and to move the looper thread through such loops of the needle thread, thereby forming a succession of chain stitches in a work piece presented to said sewing plate;

an improved cutoff mechanism comprising a stationary trimming plate including a linear gib extending beneath and parallel to said sewing plate along a path which crosses the loops of the needle and looper threads, a slide movable along said gib and carrying at least one barb having a hook and providing a first pocket means on one side of said slide and a second pocket means on the same side of said slide and spaced from said first pocket means corresponding to the spacing of the upper and lower threads on the looper head, whereby motion of said slide toward the looper head will cause said hook to move past the looper thread and the loop of the needle thread by pushing aside part of the loop of the needle thread in the looper head and the portion of the looper thread between the looper head and the previous stitch in the work piece, means for reciprocating said slide at completion of a stitching operation to move said barb past the looper thread and through the loop of the needle thread and then to reverse direction of said plate and engage the loop of the needle thread and part of the looper thread within said hook and to draw them between said trimming plate and said slide to retain a portion of each thread, and means for severing the retained portions of the looper and needle threads to free the previously formed stitches from the portions of the threads still engaged respectively by the needle and the looper head.

12. The method of trimming threads in a chainstitch sewing machine wherein a needle controlling a needle thread cooperates with an orbiting looper head controlling a looper thread to form a seam of chainstitches in a workpiece, comprising the steps of maintaining predetermined tension in the needle and looper threads during formation of a sequence of stitches, at the end of a stitching sequence, stopping the needle and looper head in a predetermined position with the needle and looper threads interengaged for forming a next stitch, inserting a capture arm into the loops of needle and looper threads, said arm having a pointed end and a plurality of pockets arranged in sequence along one side of the arm, and said arm moving in a reciprocable manner along a straight path, whereby the extension motion of the arm pushes the threads aside until the threads align with and drop into the pockets, forming a slack extension in the looper thread between the looper head and the looper thread controller, releasing the tension in the needle thread, returning the arm to a retracted position while drawing the captured threads away from the looper head, retaining the captured portion of the looper thread so the slack extension can be used to keep the looper thread engaged with the looper head, severing the captured portions of the needle and looper threads to allow removal of a stitched work piece.

* * * * *